United States Patent [19]

Sellier

[11] Patent Number: 4,605,312

[45] Date of Patent: Aug. 12, 1986

[54] WATCHBAND/WATCHCASE CONNECTION

[75] Inventor: Quentin Sellier, North Bergen, N.J.

[73] Assignee: Duchess Industries, Inc., Hoboken, N.J.

[21] Appl. No.: 699,998

[22] Filed: Feb. 8, 1985

[51] Int. Cl.[4] ..... G04B 37/00; A44C 5/18

[52] U.S. Cl. ..... 368/282; 24/265 WS; 224/177

[58] Field of Search ..... 368/281–282, 368/276; 224/164, 171, 174–177; 24/265 WS

[56] References Cited

U.S. PATENT DOCUMENTS

| | | | |
|---|---|---|---|
| 3,722,040 | 3/1973 | Meyerson | 368/282 |
| 4,231,502 | 11/1980 | Meyerson | 224/177 |
| 4,266,326 | 5/1981 | Hong | 224/177 X |

FOREIGN PATENT DOCUMENTS

| | | | |
|---|---|---|---|
| 2114643 | 8/1983 | United Kingdom | 368/276 |

*Primary Examiner*—Vit W. Miska

*Attorney, Agent, or Firm*—Kirschstein, Kirschstein, Ottinger & Israel

[57] ABSTRACT

A watchband/watchcase connection includes a bridge component which is permanently connected to the watchband, a lug component which is rigid with the watchcase, and a connecting component which connects the bridge component and the lug component, and this the watchband to the watchcase, in an assembled condition. The lug component has a channel which extends transversely as considered in the assembled condition, and the bridge component has two spaced bridge portions which are spaced from the watchband to receive the lug component between the bridge component and the watchband, and from one another in the longitudinal direction of the watchband to bound a gap that is aligned with the channel in the assembled condition. The connecting component has a first portion which is substantially snugly received in the channel, and two second portions which engage the two bridge portions, respectively. One of the second portions extends substantially normal to the first portion and forms a nose which engages the associated bridge portion from within the channel in the assembled condition, while the other of the second portions is a protuberance bent out of the remainder of the first portion and separated therefrom by two parallel slots that extend all the way to the longitudinal end of the first portion that is remote from the one of the second portions. A third portion contiguous with the one of the first portions extends outwardly in juxtaposition with the associated bridge portion.

7 Claims, 4 Drawing Figures

WATCHBAND/WATCHCASE CONNECTION

BACKGROUND OF THE INVENTION

The present invention relates to wristwatches and similar utilitarian or ornamental articles to be worn around the wrist of the user, and more particularly to a watchband/watchcase connection of such articles.

There are already known various constructions of wristwatch/watchcase connections of the type here under consideration. Many if not most of them utilize so-called spring pintles for connecting the respective end of the watchband, whether the latter is made of leather, plastic, fabric or metal, to lugs of the watchcase which are provided with respective bores for receiving the pin-shaped ends of the pintles. The longitudinally central portion of the respective pintle is then received in a sleeve-shaped formation that is a part of or permanently connected to the watchband. However, experience has shown that the pintles are very difficult to manipulate during the original assembly and subsequently, for instance, when it is desired or necessary to detach the watchband from the watchcase for any reason, such as for repair purposes, and subsequently to again establish the watchband/watchcase connection.

In view of this drawback, and others which have also been observed but which are usually considered to be less prominent, such as the need for providing an access gap for manipulating the pintle, which gap detracts from the unitary look that is desired especially in connection with metallic watchbands, it has also been previously proposed to use different constructions of the watchband/watchcase connection which rely on components other than pintles for establishing the connection between the watchcase and the watchband. So, for instance, in U.S. Pat. No. 4,231,502, there is disclosed a watchband connector which includes a lug rigid with the watchcase and having a channel extending transversely of the lug and opening on the surface of the lug that faces toward the wrist of the user in use and in an assembled condition of the connector, a bridge permanently connected to the end portion of the watchband at a region thereof which also faces the wrist of the user in use and in the assembled condition, and a connecting spring which connects the lug and the bridge with one another. In this construction, the connecting spring is constructed as a leaf spring of a generally bow-shaped configuration having tongues at its two ends which are received in respective apertures of the bridge in the assembled condition, while the arcuate central portion is received in the channel of the lug. To be able to manipulate the spring, the central portion of the latter must be received in the channel with a certain leeway, so that the spring may rattle under certain circumstances, especially when the watch is removed from the wrist and moved. This, of course, is a disadvantage because it is perceived by the prospective purchaser of the watch as a possible defect. Moreover, for taking the wristwatch and the wristband apart, it is necessary to have access to special tools capable of simultaneously engaging and depressing both of the tongues to move the central portion of the spring out of the path of movement of the lug and thus to be able to pull the latter out of the space bounded by the bridge and the associated end portion of the watchband. Without such special tooling, it is virtually impossible to disassemble the watchband and the watchcase. Last but not least, the tongues that extend into the apertures must be received in such apertures with freedom of movement at least toward and away from the watchband, so that discontinuities exist at these regions, in which parts of the garments, lint, and other similar contaminants may become caught, resulting in damage to the garments and in unsightly appearance if not interference with the operation of the connector, and which could even result in abrasions or lacerations of the skin of the user under certain circumstances. Thus, it may be seen that this known construction possesses many drawbacks.

Other constructions of watchband/watchcase connections, which have certain features in common with the present invention but which are deemed to be less relevant than the above-discussed patent, are revealed, for instance, in U.S. Pat. Nos. 3,722,040; 3,795,353; 3,889,323; 3,897,612; 3,964,652; and 4,266,326. These constructions suffer of the above discussed drawbacks, either those common to the constructions using pintles in the event that they utilize pintles for mounting the end of the watchband on the watchcase, or disadvantages similar to those discussed above in connection with U.S. Pat. No. 4,231,502 when connecting elements other than pintles are being used to mount the watchband on the watchcase.

SUMMARY OF THE INVENTION

Accordingly, it is a general object of the present invention to avoid the disadvantages of the prior art.

More particularly, it is an object of the present invention to provide a watchband/watchcase connection which does not possess the above-enumerated and other disadvantges of the conventional constructions of watchband/watchcase connectors.

Still another object of the present invention is so to design the watchband/watchcase connection of the type here under consideration as to provide a reliable and compact connection between the watchband and the watchcase and present a unitary and interruption-free appearance without any regions which could become caught or contaminated.

It is yet another object of the present invention so to construct the watchband/watchcase connection of the above type as to be able to easily manipulate the same without the use of any special tooling during the assembly and disassembly of the watchcase/watchband connection.

A comcomitant object of the present invention is to develop a watchcase/watchband connection which is relatively simple in construction, inexpensive to manufacture, easy to use, and reliable in operation nevertheless.

In pursuance of these objects and others which will become apparent hereafter, one feature of the present invention resides in a watchband/watchcase connection which comprises, in combination, a bridge component permanently connected to the watchband at one end portion of the latter and having two bridge portions extending transversely of the watchband at a first spacing from the latter to bound therewith a receiving space and at a second spacing longitudinally of the watchband from one another; a lug component rigid with the watchcase and at least partially received with minimum clearance in the receiving space in an assembled condition upon introduction from the free end of the one end portion of the watchband, the lug component having a channel extending transversely of the watchband and facing toward the second spacing in the assembled condition; and a connecting component having a first portion substantially snugly received in the channel of the lug component and two second portions having respective abutment surfaces facing in opposite longitudinal directions of the watchband away from one another and each engaging one of the bridge portions of the bridge components with interference fit in the assembled condition. A particular advantage of this construction is that the connecting element can be easily inserted between the bridge portions into the channel, and will be retained in its inserted position by the interference fit, until sufficient force is applied during the disassembly to overcome the forces resulting from the interference fit. In this respect, it is particularly advantageous when, in accordance with another feature of the present invention, the connecting component has at least a limited resiliency to brace itself with a predetermined force against the bridge portions.

It is further advantageous when the first portion of the connecting component is substantially flat; and when one of the second portions of the connecting component extends along a course substantially normal to the first portion, and the other of the second portion is a protuberance rising out of the first portion. It is also advantageous when the one of the second portions of the connecting component deviates from the substantially normal course to form a nose which, in the assembled condition, extends within the channel of the lug component to underneath the associated one of the bridge portions to engage the same from below.

According to a further aspect of the present invention, the one of the second portions of the connecting component extends substantially over the entire transverse dimension of the first portion as considered in the assembled condition. It is especially advantageous when the connecting component further includes a third portion contiguous to the one of the second portions and extending from the same substantially parallel to the first portion into juxtaposition from the inside of the watchband with the associated one of the bridge portions as considered in the assembled condition. The protuberance is advantageously constituted by a region of the first portion of the connecting component which is bent out of the plane of the remainder of the first portion. Such protuberance is advantageously situated substantially centrally of the first portion of the connecting component in the transverse direction of the latter as considered in the assembled condition and with spacing from transversely spaced marginal sections of the same. In this context, it is also contemplated to provide the first portion of the connecting component with two slots extending substantially parallel to the marginal sections of the first portion next to the protuberance to separate the latter from the marginal portions. Advantageously, such slots open onto an end face of the connecting component which is remote from the one of the second portions of the connecting component.

It will be appreciated that the construction described above is rather simple, but that it achieves excellent results. So, for instance, since the connecting component practically fills the space between the bridge portions and the channel, there is no room left for contaminants to accumulate in. Also, there are no protruding edges or projections which could damage garments or the skin of the user. The assembly and disassembly of the watchband/watchcase combination can be easily accomplished.

The novel features which are considered as characteristic of the invention are set forth in particular in the appended claims. The improved watchband/watchcase connection itself, however, both as to its construction and its mode of operation, together with additional features and advantages thereof, will be best undestood upon perusal of the following detailed description of certain specific embodiments with reference to the accompanying drawing.

DETAILED DESCRIPTION OF THE PREFERRED EMBODIMENT

Figure 1:
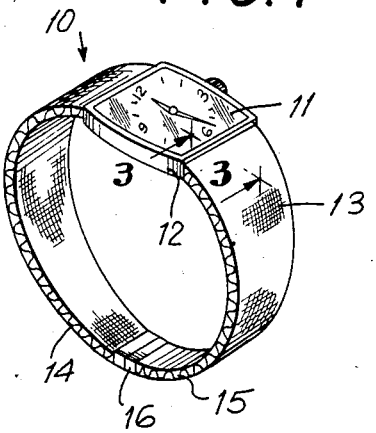
FIG. 1 is a perspective view of a wristwatch constructed in accordance with the present invention in a fully assembled condition thereof.

Referring now to the drawing in detail, and first to FIG. 1 thereof, it may be seen that the reference numeral 10 has been used therein to identify a wristwatch in its entirety. The wristwatch 10 comprises, as its main constituent elements, a watch 11 which includes a watchcase 12, and a watchband 13, which is preferably of the metallic variety well known to those familiar with wristwatches and which is shown to consist of two band portions 14 and 15 which are connected to the watchcase 12 at one of their ends each, and to one another at the other ends, via a connecting arrangement or latch which may be of any known construction that will not be discussed here since it is unrelated to the present invention. Moreover, it will be appreciated that the latch or clasp 16 can be omitted altogether, if the watchband 13 is of the expandable type as also known, in which case the watchband will not be separated into the band portions 14 and 15.

Figure 2:
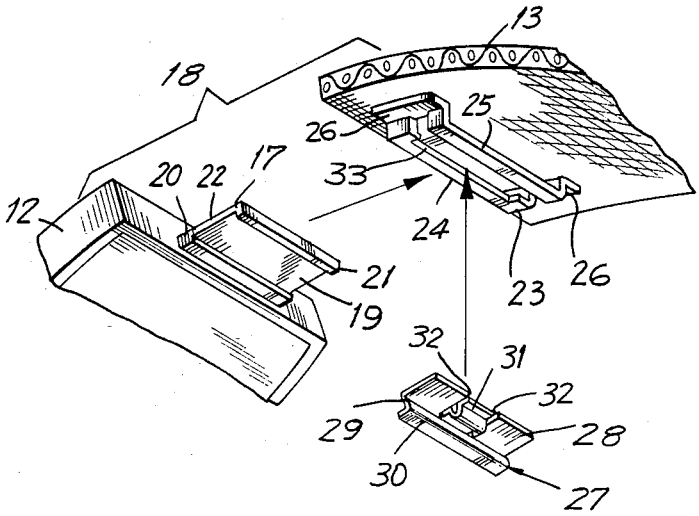
FIG. 2 is an enlarged fragmentary perspective view showing the region of connection of the watchband to the watchcase as viewed from inside, with the various components thereof in accordance with the present invention being depicted in an exploded disassembled state.

As shown in detail in FIG. 2, the watchcase 12 is provided at its region to be connected to the watchband 13 with a lug component 17 of a watchband/watchcase connection 18. The lug component 17 is rigid with the watchcase 12 and is provided with a channel 19 which extends transversely of the watchband 13 as considered in the assembled condition of the watchband/watchcase connection 18. The channel 19 is bounded by two end walls 20 and 21 and a bottom wall 22 and is open at its transverse ends. In use, the channel 19 opens toward the wrist region of the user of the wristwatch 10.

The watchband/watchcase connection 18 further includes a bridge component 23 which is permanently connected to the respective end portion of the watchband 13 at a short distance from the end thereof that is to be connected to the aforementioned region of the watchcase 12. The bridge component 23 includes two bridge portions 24 and 25 which are spaced a first distance from the watchband 13, this distance substantially corresponding to the thickness of the lug component 17 as measured from the bottom of the bottom wall 22 to the top of the end walls 20 and 21, and a second distance from one another, this second distance being smaller than the distance between the inner surfaces of the end walls 20 and 21 of the lug component 17. The bridge portions 24 and 25 bound a receiving space for the lug component 17 in the assembled condition such that the lug component is received in this receiving space with minimum freedom of movement, if any, in any other direction than that in which it is introduced into the receiving space and opposite thereto. The bridge portions 24 and 25 are shown to be integral with mounting portions 26 which interconnect the same and are in turn permanently connected to the watchband 13.

Finally, the watchband/watchcase connection 18 also includes a connecting component 27 which is separate from both the watchcase 12 and the watchband 13 but which connects the lug component 17 with the bridge component 23 in the assembled condition of the watchband/watchcase connection 18 to connect the watchband 13 to the watchcase 12. The connecting component 27 is of a resilient sheet material and is stamped or otherwise deformed into its shape. The connecting component 27 includes a substantially flat first portion 28, a second portion 29 which extends substantially normal from the first portion 28, and a third portion 30 which is contiguous with the second portion 29 and extends substantially parallel to the first portion 28 but at an offset therefrom as provided by the second portion 29. A protuberance 31 is stamped or otherwise deformed out of the remainder of the first portion 28 to serve as another second portion. The protuberance is laterally separated from the remainder of the first portion 28 and particularly from the lateral marginal sections thereof by two slots 32 which open onto that end of the first portion 28 that is remote from the second portion 29.

Figure 3:
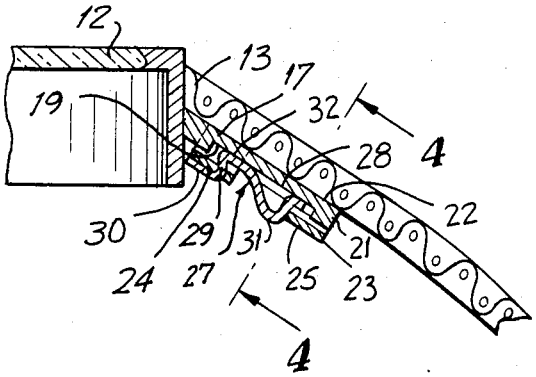
FIG. 3 is a sectional view taken though the region of FIG. 3 as taken on line 3—3 of FIG. 1 and in the assembled condition.

In the assembled condition, as shown in particular in FIG. 3, the spacing between the bridge portions 24 and 25 is in registry with the channel 19, and the connecting component 27 is introduced through the spacing between the bridge portions 24 and 25 of the bridge component 23 into the channel 19. The protuberance 31 engages and presses against the bridge portion 25, while the second portion 29 engages and presses against the bridge portion 24 to retain the connecting component 27 in the illustrated position and thus to lock the lug component 17 in its shown position in the receiving space bounded by the bridge component 23. The second portion 29 of the connecting component 27 slightly deviates from its general course, which is substantially normal to the first portion 28, to form a nose which engages the bridge portion 24 from within the channel 19 to improve retention of the connecting component 27 on the bridge component 23. The third portion 30 of the connecting component 27 extends in justaposition with the bridge portion 24 of the bridge component. The first portion 28 of the connecting component rests against the bottom wall 22 of the lug component 17 and abuts against the end wall 21.

During the assembly of the wristwatch 10, the lug portion 17 is first slid into the receiving space bounded between the bridge component 23 and the watchband 13. Then, the connecting component 27 is assembled with the remainder of the watchband/watchcase connection 18 in the orientation depicted in FIGS. 2 and 3, that is, the first portion 28 thereof is first introduced into the channel 19 and then pressure is applied against the third portion 30 to cause the nose 32 to move past the bridge portion 24 while being resiliently deflected out of the way during this stage of the assembling operation, until the third portion 30 contacts the bridge portion 24 or until no further movement is possible. The resiliency of the connecting component 27, and especially the action of the second portion 29 in bracing itself against the bridge portion 24 causes the protuberance 31 to be resiliently pressed against the bridge portion 25. In this manner, there is obtained what can be called an interference fit of the connecting component 27 in the spacing between the bridge portions 24 and 25. During disassembly, the above steps are simply reversed, that is, the third portion 30 is first lifted off of the bridge portion 25 by inserting a sharp edge or tip between the third portion 30 and the bridge portion 24 until the nose 32 clears the bridge portion 24 on its way past the latter out of the channel 19, whereupon the first portion 28 can be easily removed from the channel 19 through the spacing between the bridge portions 24 and 25.

Figure 4:
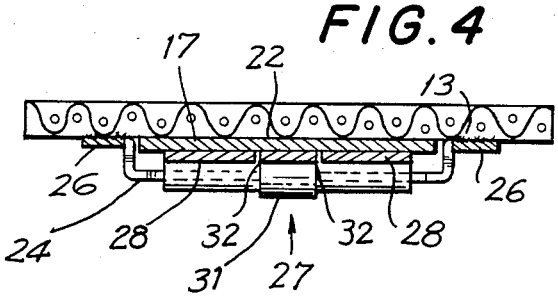
FIG. 4 is a transverse partially sectioned view taken on line 4—4 of FIG. 3.

FIG. 4 shows in more detail certain features of the watchband/watchcase connection 18. It may be seen therein particularly that the receiving space for the lug component 17 is somewhat wider than the connecting component 27. To hold the latter in position transversely of the watchband 13, the bridge portion 24 is provided, as shown particularly in FIG. 2, with a cutout 33 dimensioned to receive the second portion 29 with substantially no lateral clearance.

It will be understood that each of the elements described above, or two or more together, may also find a useful application in other types of arrangements differing from the type described above. So, for instance, instead of being used in a wristwatch, the connection 18 of the present invention could be used in any other utilitarian or ornamental article to be worn around the wrist of the user, such as a bracelet or the like.

While the invention has been illustrated and described as embodied in a wristwatch with a metallic band or strap, it is not intended to be limited to the details shown since various modifications and structural changes may be made without departing in any way from the spirit of the present invention. Thus, for example, the band or strap 13, rather than being made of a metallic material or mesh, could be made of leather, fabric, plastic or any other suitable material, so long as the bridge component 23 can be securely and permanently connected thereto.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A watchband/watchcase connection comprising:

a bridge component permanently connected to the watchband at one end portion of the latter and having two bridge portions extending transversely of the watchband at a first spacing from the latter to bound therewith a receiving space and at a second spacing longitudinally of the watchband from one another;

a lug component rigid with the watchcase and at least partially received with minimum clearance in said receiving space in an assembled condition upon introduction from the free end of the one end portion of the watchband, said lug component having a channel extending transversely of the watchband and facing toward said second spacing in said assembled condition; and a connecting component having at least a limited resiliency to brace itself with a predetermined force against said bridge portions, and including a first substantially flat portion substantially snugly received in said channel of said lug component, and two second portions having respective abutment surfaces facing in opposite longitudinal directions of the watchband away from one another and each engaging one of said bridge portions of said bridge components with interference fit in said assembled condition, one of said second portions of said connecting component extending along a course substantially normal to said first portion, and the other of said second portions being a protuberance rising out of said first portion, said one of said second portions of said connecting component deviating from said substantially normal course to form a nose which, in said assembled condition, extends within said channel of said lug component to underneath the associated one of said bridge portions to engage the same from below.

2. The watchband/watchcase connection as defined in claim 1, wherein said one of said second portions of said connecting component extends substantially over the entire transverse dimension of said first portion as considered in said assembled condition.

3. The watchband/watchcase connection as defined in claim 1, wherein said protuberance is constituted by a region of said first portion of said connecting component which is bent out of the plane of the remainder of said first portion.

4. The watchband/watchcase connection as defined in claim 3, wherein said protuberance is situated substantially centrally of said first portion of said connecting component in the transverse direction of the latter as considered in said assembled condition and with spacing from the transversely spaced marginal sections of the same.

5. A watchband/watchcase connection comprising:

a bridge component permanently connected to the watchband at one end portion of the latter and having two bridge portions extending transversely of the watchband at a first spacing from the latter to bound therewith a receiving space and at a second spacing longitudinally of the watchband from one another;

a lug component rigid with the watchcase and at least partially received with minimum clearance in said receiving space in an assembled condition upon introduction from the free end of the one end portion of the watchband, said lug component having a channel extending transversely of the watchband and facing toward said second spacing in said assembled condition; and a connecting component having at least a limited resiliency to brace itself with a predetermined force against said bridge portions, and including a first substantially flat portion substantially snugly received in said channel of said lug component, and two second portions having respective abutment surfaces facing in opposite longitudinal directions of the watchband away from one another and each engaging one of said bridge portions of said bridge components with interference fit in said assembled condition, one of said second portions of said connecting component extending along a course substantially normal to said first portion, and the other of said second portions being a protuberance rising out of said first portion;

said connecting component further including a third portion contiguous to said one of said second portions and extending from the same substantially parallel to said first portion into juxtaposition from the inside of the watchband with the associated one of said bridge portions as considered in said assembled condition.

6. A watchband/watchcase connection comprising:

a bridge component permanently connected to the watchband at one end portion of the latter and having two bridge portions extending transversely of the watchband at a first spacing from the latter to bound therewith a receiving space and at a second spacing longitudinally of the watchband from one another;

a lug component rigid with the watchcase and at least partially received with minimum clearance in said receiving space in an assembled condition upon introduction from the free end of the one end portion of the watchband, said lug component having a channel extending transversely of the watchband and facing toward said second spacing in said assembled condition; and a connecting component having at least a limited resiliency to brace itself with a predetermined force against said bridge portions, and including a first substantially flat portion substantially snugly received in said channel of said lug component, and two second portions having respective abutment surfaces facing in opposite longitudinal directions of the watchband away from one another and each engaging one of said bridge portions of said bridge components with interference fit in said assembled condition, one of said second portions of said connecting component extending along a course substantially normal to said first portion, and the other of said second portions being a protuberance rising out of said first portion, said protuberance being constituted by a region of said first portion of said connecting component which is bent out of the plane of the remainder of said first portion, said protuberance being situated substantially centrally of said first portion of said connecting component in the transverse direction of the latter as considered in said assembled condition and with spacing from the transversely spaced marginal sections of the same, and said first portion of said connecting component having two slots extending substantially parallel to said marginal sections of said first portion next to said protuberance to separate the latter from said marginal portions.

7. The watchband/watchcase connection as defined in claim 6, wherein said slots open on an end face of said first portion of said connecting component which is remote from said one of said second portions of said connecting component.

* * * * *